US012181244B2

(12) United States Patent
Kowalczyk, Jr. et al.

(10) Patent No.: US 12,181,244 B2
(45) Date of Patent: Dec. 31, 2024

(54) AIRGUN MAGAZINE

(71) Applicant: Crosman Corporation, Bloomfield, NY (US)

(72) Inventors: John A. Kowalczyk, Jr., Fairport, NY (US); Jeffrey D. Hanson, Honeoye Falls, NY (US); Kenneth A. Call, Rush, NY (US)

(73) Assignee: Crosman Corporation, Bloomfield, NY (US)

( * ) Notice: Subject to any disclaimer, the term of this patent is extended or adjusted under 35 U.S.C. 154(b) by 0 days.

(21) Appl. No.: 18/375,895

(22) Filed: Oct. 2, 2023

(65) Prior Publication Data

US 2024/0102770 A1 Mar. 28, 2024

Related U.S. Application Data

(63) Continuation of application No. 17/576,150, filed on Jan. 14, 2022, now Pat. No. 11,774,211, which is a (Continued)

(51) Int. Cl.
*F41B 11/54* (2013.01)

(52) U.S. Cl.
CPC ..... *F41B 11/54* (2013.01)

(58) Field of Classification Search
CPC ..... F41B 11/50; F41B 11/54; F41B 11/62; F41A 9/73

(Continued)

(56) References Cited

U.S. PATENT DOCUMENTS 836,532 A * 11/1906 Picken ..... F41B 11/647 124/67
2,609,811 A * 9/1952 Lawrence ..... F41B 11/54 124/48

(Continued)

FOREIGN PATENT DOCUMENTS

DE 494764 C 3/1930
DE 4114152 A1 11/1991

(Continued)

OTHER PUBLICATIONS

PCT Search Report and Written Opinion mailed Mar. 25, 2021 for PCT application No. PCT/US21/14328, 11 pages.

(Continued)

*Primary Examiner* — Alexander R Niconovich
(74) *Attorney, Agent, or Firm* — Lee & Hayes, P.C.

(57) ABSTRACT

A projectile magazine for use with an airgun having a bolt is described herein. The magazine includes a housing with a loading end and openings along a longitudinal axis extending from the loading end to a loading area. The magazine further includes a carousel with a plurality of projectile holders movable through the loading area. Each projectile holder has a projectile holder gap facing the loading end when in the loading area. The projectile holder gap is smaller than a width of the bolt and the projectile holder is resiliently deformable to allow the bolt through the projectile holder gap when exposed to forces created during separation of the magazine and the bolt through the frame gap while the projectile holder does not deform to allow a projectile to be removed from the projectile gap when exposed to the forces generated by a projectile during use of the magazine.

20 Claims, 9 Drawing Sheets

Related U.S. Application Data continuation of application No. 17/153,612, filed on Jan. 20, 2021, now Pat. No. 11,226,168.

(60) Provisional application No. 62/964,490, filed on Jan. 22, 2020.

(58) Field of Classification Search
USPC ..... 124/48
See application file for complete search history.

(56) References Cited

U.S. PATENT DOCUMENTS

| | | | | | |
|---|---|---|---|---|---|
| 2,962,017 | A * | 11/1960 | Horowitz | F41B 7/006 | 124/48 |
| 3,561,319 | A * | 2/1971 | Joyce | F41A 9/23 | 42/59 |
| 3,782,359 | A * | 1/1974 | Kester | F41B 11/62 | 124/48 |
| 3,913,553 | A * | 10/1975 | Braughler | F41B 11/54 | 124/48 |
| 4,422,433 | A * | 12/1983 | Milliman | F41A 9/28 | 124/48 |
| 4,986,251 | A * | 1/1991 | Lilley | F41B 11/54 | 124/52 |
| 5,150,701 | A * | 9/1992 | Wackrow | F41B 11/57 | 124/52 |
| 5,280,778 | A | 1/1994 | Kotsiopoulos | | |
| 5,511,333 | A * | 4/1996 | Farrell | F41B 11/55 | 42/49.01 |
| 5,522,374 | A * | 6/1996 | Clayton | F41B 11/646 | 124/66 |
| 5,845,629 | A * | 12/1998 | Ratliff | F42B 6/10 | 473/573 |
| 6,470,871 | B2 * | 10/2002 | Casas-Salva | F41B 11/54 | 124/67 |
| 6,729,322 | B2 * | 5/2004 | Schavone | F41B 11/51 | 89/33.03 |
| 7,159,584 | B2 * | 1/2007 | Maeda | F41A 9/73 | 89/33.02 |
| 7,395,763 | B1 * | 7/2008 | Vari | F41A 29/00 | 42/95 |
| 8,402,958 | B2 * | 3/2013 | Victor | F41A 9/73 | 89/33.17 |
| 8,931,467 | B2 * | 1/2015 | Lee | F41A 9/26 | 124/56 |
| 9,134,090 | B1 * | 9/2015 | Park | F41B 11/55 | |
| 10,066,896 | B2 * | 9/2018 | Zhu | F41B 11/50 | |
| 10,197,355 | B2 * | 2/2019 | Lamboy | F41B 11/683 | |
| 10,267,593 | B2 * | 4/2019 | Lamboy | F41B 11/54 | |
| 10,323,892 | B2 * | 6/2019 | Tresserras Torre | F41B 11/55 | |
| 11,002,508 | B2 * | 5/2021 | Miller | F41B 11/50 | |
| 11,029,124 | B2 * | 6/2021 | Call | F41B 11/648 | |
| 11,098,976 | B2 * | 8/2021 | Call | F41B 11/54 | |
| 11,353,279 | B2 * | 6/2022 | Chia | F41B 7/006 | |
| 11,353,282 | B2 * | 6/2022 | Call | F41B 11/62 | |
| 11,668,545 | B2 * | 6/2023 | Arnedo Vera | F41A 9/74 | 124/48 |
| 2003/0094167 | A1 * | 5/2003 | Nibecker, Jr. | F41B 11/723 | 124/64 |
| 2005/0072415 | A1 * | 4/2005 | Schavone | F41B 11/71 | 124/31 |
| 2010/0229844 | A1 * | 9/2010 | Gore | F41B 11/73 | 124/80 |
| 2014/0331855 | A1 * | 11/2014 | Hanson | F41B 11/642 | 92/261 |
| 2019/0195594 | A1 * | 6/2019 | Lamboy | F41B 11/647 | |
| 2019/0234264 | A1 | 12/2019 | Julian | | |
| 2019/0383575 | A1 * | 12/2019 | Chia | A63F 9/0278 | |
| 2020/0096287 | A1 | 3/2020 | Miller et al. | | |
| 2020/0232749 | A1 | 7/2020 | Call | | |
| 2020/0263950 | A1 | 8/2020 | Call | | |
| 2021/0222991 | A1 | 7/2021 | Kowalczyk, Jr. et al. | | |
| 2021/0318095 | A1 | 10/2021 | Call et al. | | |
| 2022/0221245 | A1 | 7/2022 | Arnedo Vera et al. | | |
| 2023/0079588 | A1 * | 3/2023 | Ma | F41B 11/54 | 124/6 |

FOREIGN PATENT DOCUMENTS

| | | | |
|---|---|---|---|
| ES | 2191508 | A1 | 9/2003 |
| GB | 2152646 | A | 1/1988 |
| KR | 101401865 | B1 | 5/2014 |
| WO | WO2019234264 | A1 | 12/2019 |

OTHER PUBLICATIONS

Extended European Search Report mailed Jan. 3, 2024 for European Application No. 21791847.3, a foreign counterpart to U.S. Pat. No. 11,353,282, 6 pages.

Extended European Search Report mailed Dec. 22, 2023 for European Application No. 21745150.9, a foreign counterpart to U.S. Pat. No. 11,226,168, 12 pages.

Office Action for U.S. Appl. No. 17/739,518, mailed on Feb. 10, 2023, Kenneth A. Call, Multi-Shot Airgun, 9 pages.

Office Action for U.S. Appl. No. 17/153,612 mailed on May 28, 2021, Kowalczyk, John "Airgun Magazine" 7 pages.

Office Action for U.S. Appl. No. 17/153,661, mailed on Oct. 6, 2021, Call, "Multi-Shot Airgun", 5 Pages.

International Search Report and Written Opinion for PCT Application No. PCT/US2021/014331, mailed Oct. 7, 2021, 7 pages.

* cited by examiner

AIRGUN MAGAZINE

CROSS REFERENCE TO RELATED APPLICATIONS

This patent application is a continuation of and claims priority to U.S. Utility patent application Ser. No. 17/576,150, filed Jan. 14, 2022, which is a continuation of and claims priority to U.S. Utility patent application Ser. No. 17/153,612, filed Jan. 20, 2021, which claims priority to U.S. Provisional Patent Application No. 62/964,490, filed Jan. 22, 2020, the entire contents of which are fully incorporated herein by reference.

STATEMENT REGARDING FEDERALLY SPONSORED RESEARCH OR DEVELOPMENT

N/A

REFERENCE TO SEQUENCE LISTING, A TABLE, OR A COMPUTER PROGRAM LISTING COMPACT DISC APPENDIX

N/A

FIELD OF THE INVENTION

This invention relates to magazines of the type that hold projectiles for use in airguns.

BACKGROUND OF THE INVENTION

Magazine type automatic loading systems have been a long standing feature in airgun design. U.S. Pat. No. 4,986,241, entitled Airgun Magazine and issued to Lilley on Jan. 22, 1991 describes one type of magazine design. As is shown in FIG. 1, the magazine of the '241 patent has an outer case 1, a circular pellet carrier 2 rotatably mounted in the outer case 1, and a cover 3 that is pivotally mounted on the outer case 2. A coil spring 4 resiliently biases the pellet carrier 2 towards an end position and a screw 5 is used to assemble these parts. To load the magazine, the cover 3 is pivoted to cause the pellet carrier 2 to rotate to another end position, and a soft lead airgun pellet is then dropped in through a hole 7 in the outer cover 3 into a pellet chamber in the pellet carrier. The outer cover 3 is then rotated, allowing successive pellets to be dropped into successive pellet chambers within the pellet carrier 2.

In use, a probe likewise pushes through hole 7, through a pellet chamber of pellet carrier 2 and through a hole 8 in cover 3 to push the first pellet out of the magazine into the breach of an airgun. While in the magazine, the bolt prevents indexing of the pellet carrier.

When the bolt is next retracted, the magazine automatically indexes under spring pressure position the next pellet against a stop 11 which positions the pellet for loading. The pellets themselves serve as part of the indexing mechanism. The transfer probe places the pellets accurately in position within the breach of the airgun.

In spring loaded magazines such as the magazine described in the '241 patent, it is necessary to rotate the pellet carrier against the bias of the coil spring before loading—effectively cocking the magazine. However, as noted above indexing of the pellet carrier in magazines of this type is arrested by the presence of a pellet in a position that is ready for loading into an airgun. This, in turn, requires that a pellet be placed in such a position while the user is simultaneously holding the pellet carrier against the force of the coil spring.

What is needed therefore is a magazine that delivers a less demanding loading experience for a user. However, in providing a magazine with an improved user loading experience it is important to ensure that interactions between the magazine and the airgun remain efficient and effective.

A pellet carrier of the '241 patent requires each pellet holder to fully surround each pellet with concomitant width, height, and weight consequences. Further, the pellet carrier of the '241 patent uses a stop 11 that passes through each of the pellet holders after a pellet has been discharged therefrom. This imposes a complex pellet carrier design and pellet chamber design while also demanding close tolerances be held between stop 11 and pellet carrier 1.

Accordingly what is also sought is a lighter, smaller, less complex and more resilient airgun magazine.

Further, it will be appreciated that when a bolt is positioned inside magazine, outer case 1 and outer cover 3 surround the bolt. This blocks a user from removing the magazine when the bolt is in place. Such a removal may be necessary or desirable for example where maintenance or service is required with the bolt in such a position.

Accordingly what is also needed is a new approach to airgun magazines that allows for magazine removal when the bolt is advanced through the magazine and provides improved user loading experiences without impacting interactions between the magazine and the airgun.

DETAILED DESCRIPTION

Figure 1:
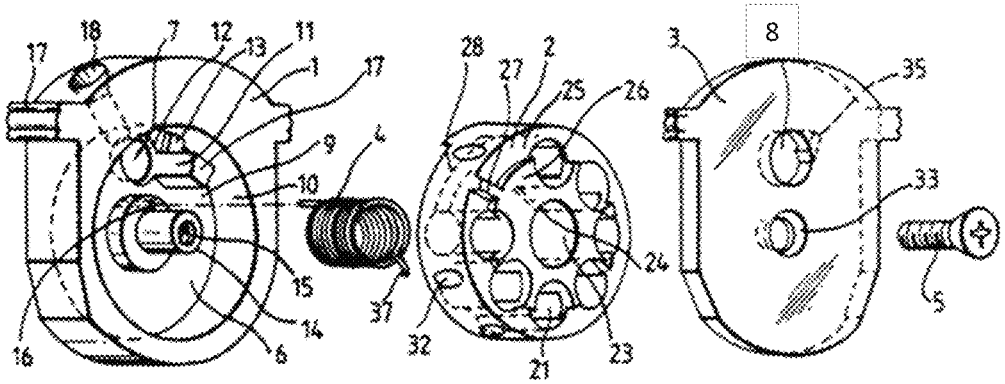
FIG. 1 (Prior art)
FIG. 1 is a right side perspective assembly view of an airgun magazine of the prior art.
Figure 2:
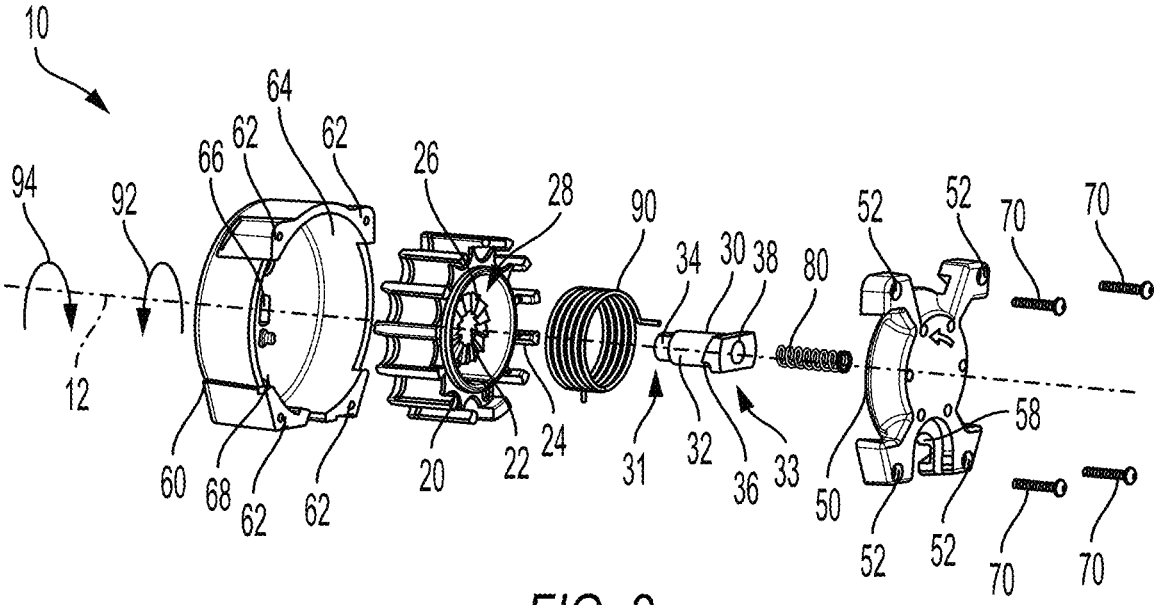
FIG. 2 is an assembly view of one embodiment of a magazine from a left and top perspective.
Figure 3:
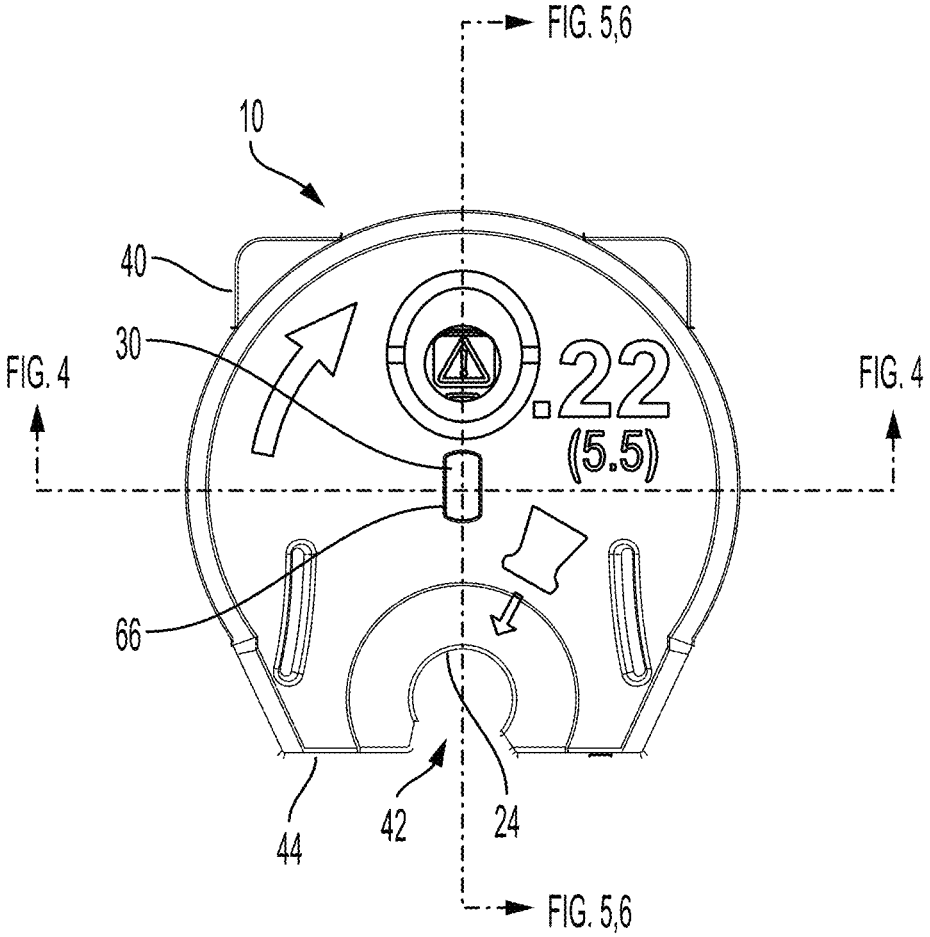
FIG. 3 is a front elevation view of the embodiment of FIG. 1 in an assembled state.

FIG. 2 is an assembly view of one embodiment of a magazine 10 from a left and top perspective. FIG. 3 is a back elevation view of a magazine 10 of the embodiment of FIG. 2 assembled.

In this embodiment, magazine 10 has a carousel 20 with a longitudinally extending hub 22. Hub 22 is rotatably mountable to a control axle 30.

A plurality of longitudinally extending projectile holders 24 is arranged in an arcuate or circular fashion about hub 22 and a ratchet surface 26 is also arranged in an arcuate or circular fashion about hub 22 between hub 22 and the plurality of projectile holders 24. Hub 22, projectile holders 24 and ratchet surface 26 are linked for rotation about hub 22 along an axis that is not parallel to the longitudinal axis 12.

A magazine housing 40 is provided as a framework to which carousel 20, control axle 30, a control axle biasing element 80, and rotation bias spring 8 can be supported directly or indirectly. In embodiments, housing 40 may provide surfaces and seals that limit or protect these components and projectiles loaded therein from environmental contamination.

In this embodiment, a magazine housing 40 is provided in parts: a first housing part 50 and a second housing part 60 and first housing part 50 and second housing part 60 have fastener mountings 52 and 62 respectively that can be joined together by way of fasteners 70 to form housing 40 and to contain, position, or provide a reference for positioning directly or indirectly other components of magazine 10.

First housing part 50 provides a first opening 58 and second housing part 60 provides a second opening 68. First opening 58 is axially aligned with second opening 68. First opening 58 and second opening 68 are sized and longitudinally aligned to permit a bolt of an airgun (not shown) and a projectile (not shown) held by one of the projectile holders 24 of carousel 20 to move longitudinally through a loading area 42 between first opening 58 and second opening 68.

A carousel holding space 64 is provided between first housing part 50 and second housing part 60. In the embodiment of FIG. 2, second housing part 60 provides a carousel holding space 64 that is sized and shaped to hold carousel 20 while permitting carousel 20 to rotate at least in part within carousel holding space 64.

Control axle 30 has an axle portion 32, a control axle tab 34, a pawl surface 36, and a control axle biasing member mount 38. Axle portion 32 is sized and shaped so that hub 22 can be mounted to axle portion 32 for rotation about axle portion 32 at a generally fixed axial location with housing 40.

Control axle tab 34 is sized and shaped for insertion into slot 66 of second housing part 60 to locate a first end 31 of control axle 30 relative to housing 40.

Figure 4:
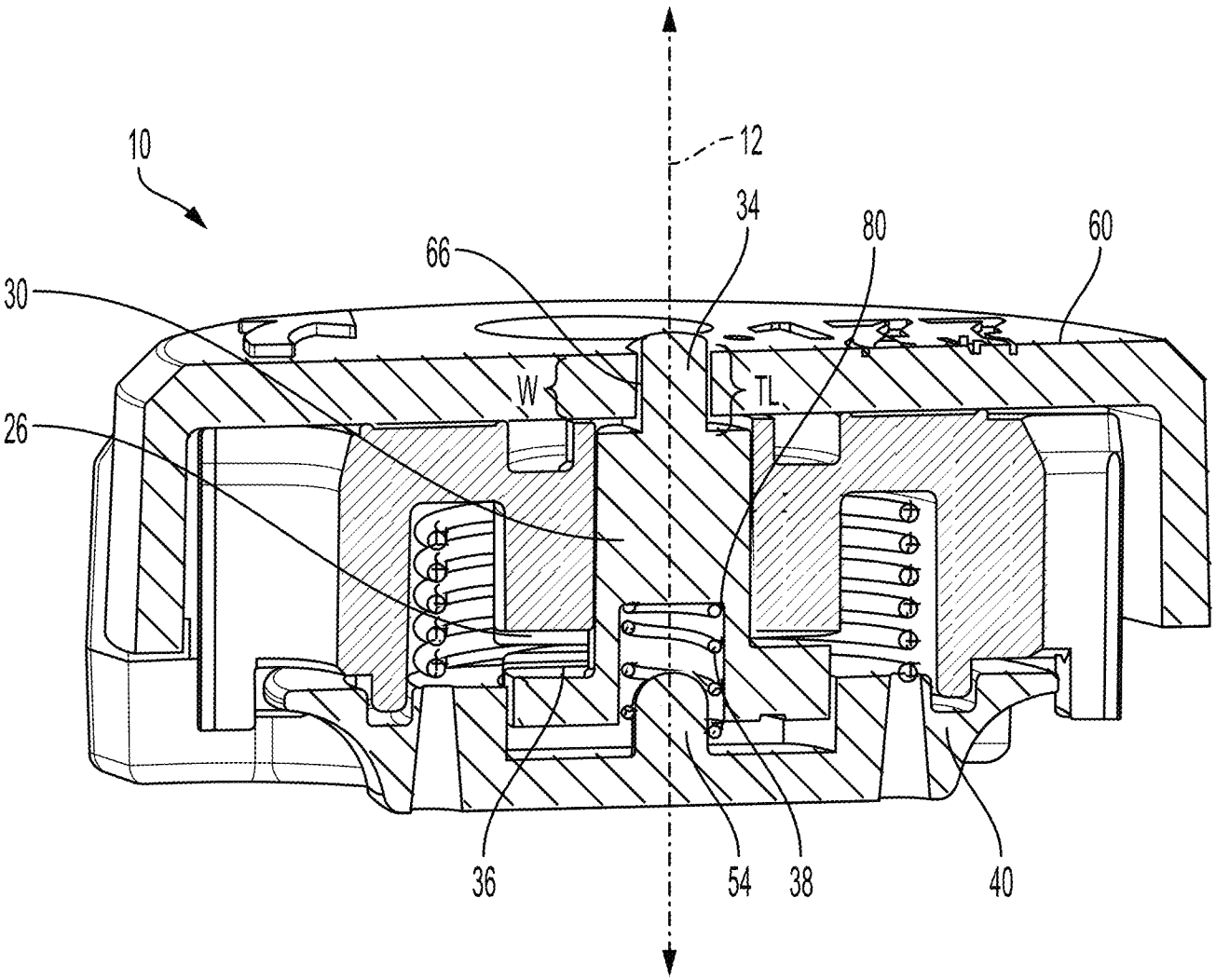
FIG. 4 shows a front left side, top perspective view of the embodiment of FIG. 1 in an assembled state.

In embodiments, an optional second control axle mount 54 can be provided as shown in FIG. 4 to locate the first end 33 of control axle 30 relative to housing 40. Other known structures for of securing the location of first end 33 can be used.

Slot 66 and control axle tab 34 cooperate to position control axle 30 within carousel holding space 64 so that projectile holders 24 rotate along a path that brings projectile holders 24 between first opening 58 and second opening 68 to provide a loading area 42 at a loading end 44 of housing 40 where a projectiles can be loaded by a user into one of the projectile holders and where a bolt of an airgun (not shown) can pass through magazine 10 to move a projectile out of magazine 10 and into a breach or other component of a loading system of an airgun (not shown).

Pawl surface 36 is shaped and positioned to engage ratchet surface 26 as will be described in greater detail below.

Control axle biasing member mount 38 is sized and shaped to receive and to position a control axle biasing element 80 between control axle biasing member mount 38 and first housing part 50.

In this embodiment, control axle biasing element 80 is positioned and configured to cooperate with first housing part 50 to urge control axle 30 toward second housing part 60. In the embodiment illustrated, control axle biasing element 80 is shown as a coil compression spring that is sized and shaped to fit within a control axle biasing member mount 38 and control axle biasing member mount 38 is shown in the form of a generally cylindrical sleeve that is generally co-axial with axle portion 32.

Also shown is a rotational biasing element 90. Rotational biasing element 90 is positioned between magazine housing 40 and carousel 20 and is configured to bias carousel 20 to rotate in a first direction 92 about longitudinal axis 12. In this embodiment, rotational biasing element 90 takes the form of a coil spring.

As will be discussed in greater detail below, during the process of loading projectiles into projectile holders 24 of carousel 20, carousel 20 is rotated in a second direction 94 about longitudinal axis 12 that is the opposite of first direction 92. This stores energy in rotational biasing element 90 that is later released by rotational biasing element 90 to rotate carousel 20 in first direction 92.

As is shown in FIGS. 2 and 3, control axle tab 34 has a non-circular cross-section shaped to correspond with a non-circular cross section of slot 66. This allows control axle 30 to resist rotation about the longitudinal axis at times when carousel 20 is allowed to rotate about control axle 30. In other embodiments, control axle 30 can be held against rotation with carousel 20 in other ways including but not limited to providing surfaces on first housing part 50 to engage features at first end 33 of control axle 30.

FIG. 4 is a cross-section of the embodiment of FIG. 2 taken as illustrated in FIG. 3. As is illustrated in FIG. 4, control axle tab 34 has a length L along the longitudinal axis 12 that is greater than a width W of second housing part 60 proximate to slot 66. Further, a longitudinal separation between second housing part 60 and first housing part 50 along the longitudinal axis is greater than a length of portions of control axle 30 other than control axle tab 34. Accordingly, control axle 30 can be moved generally parallel to longitudinal axis 12.

Carousel 20 and control axle 30 are configured so that there is sufficient range of longitudinal motion between carousel 20 and control axle 30 to allow ratchet surface 26 and pawl surface 36 to be positioned in contact in a first portion of the range and to be positioned out of contact in a second portion of the range.

Figure 5:
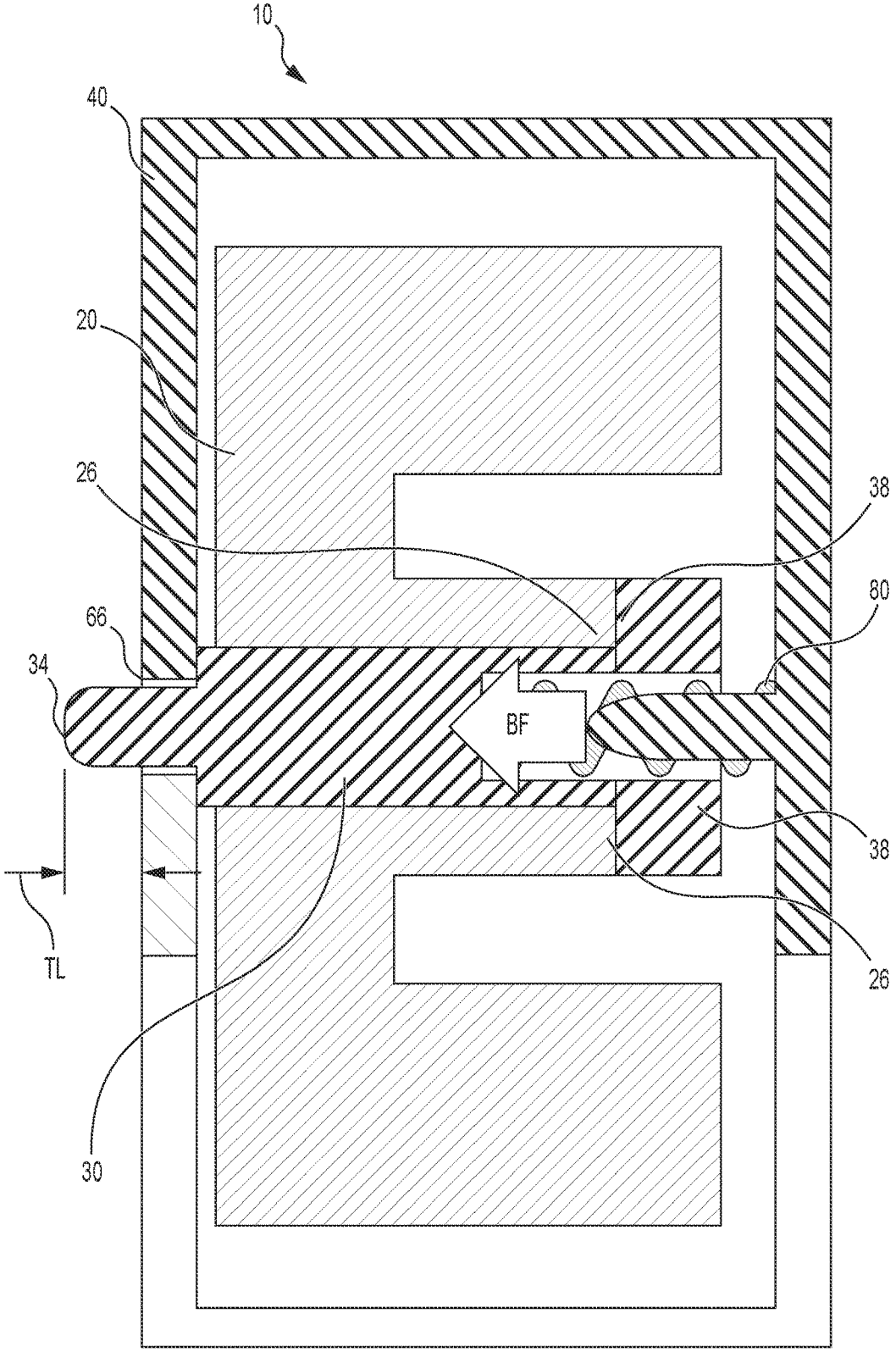
FIG. 5 is a right side cross-sectional schematic representation of the embodiment of FIG. 1 with a ratchet surfaces of a carousel engaged with a pawl surface of a control axle.

FIGS. 4 and 5 show a schematic cross section of magazine 10 to illustrate these interactions.

As is shown in FIG. 5, control axle biasing element 80 applies a biasing force BF that urges control axle 30 toward second housing part 60 which has the effect of biasing pawl surface 36 into engagement with ratchet surface 26. This also has the effect of positioning a tip length TL of control axle tab 34 through slot 66 and outside of housing 40.

Figure 6:
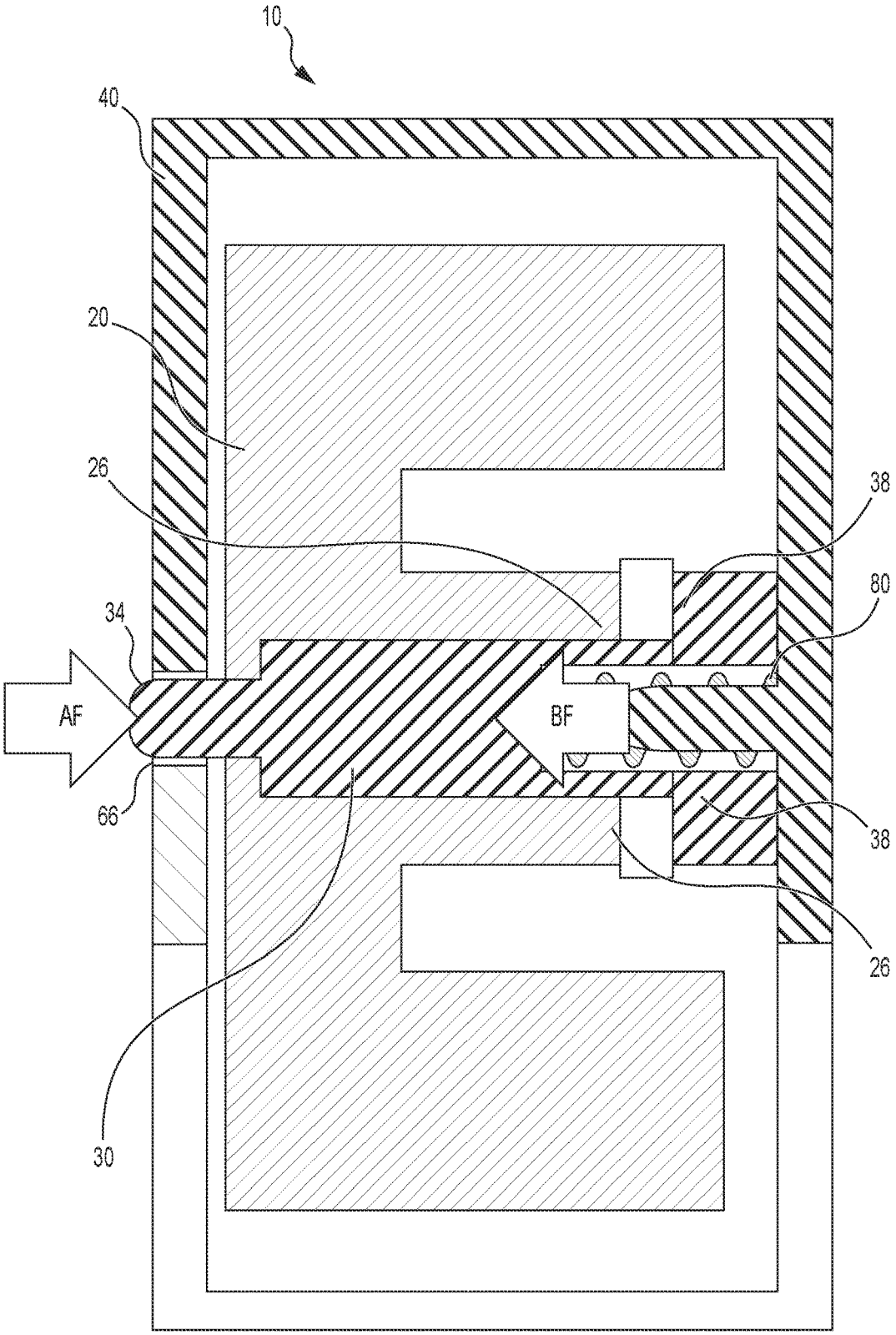
FIG. 6 is a right side cross-sectional schematic representation of the embodiment of FIG. 1 with a ratchet surfaces of a carousel disengaged with a pawl surface of a control axle.

However, as is shown schematically in cross section in FIG. 6, when an activating force AF is applied to control axle tab 34 that overcomes the biasing force BF, at least a portion of tip length TL through slot 66 and into housing 40 moving control axle 30 relative to carousel 20 so as to separate ratchet surface 26 from pawl surface 36 and ending any interactions between ratchet surface 26 and pawl surface 36.

Figure 7:
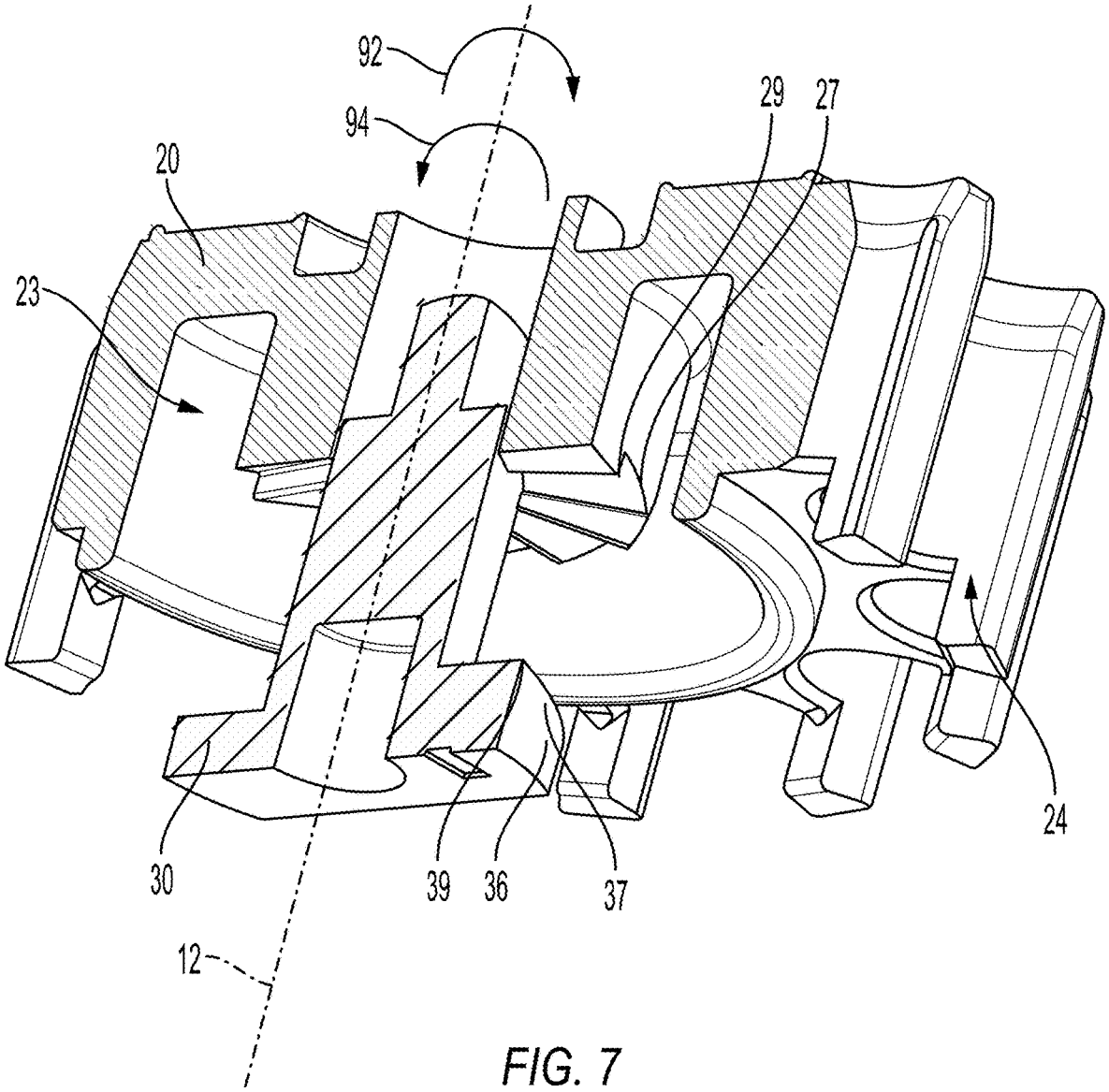
FIG. 7 shows a cross section of carousel and control axle of the type used in the embodiment of FIG. 1.

FIG. 7 shows a cross section of carousel 20 and control axle 30. As is shown in FIG. 7, in this embodiment, ratchet surface 26 has a repeating pattern of inclined planes 27 terminating in longitudinally extending step 29. Pawl surface 36 has pattern of inclined planes and steps that conform with the pattern of inclined planes and steps of ratchet surface 26.

This arrangement permits carousel 20 to rotate about longitudinal axis 12 in second direction 94 when ratchet surface 26 and pawl surface 36 are engaged but blocks rotation in a first direction 92.

In this embodiment, carousel 20 is rotated in the first direction 92 during firing and in the second direction 94 during loading of projectiles.

Accordingly, during loading the bias applied by rotational biasing element 90 is experienced by the user as the user rotates carousel 20 to index individual ones of projectile holders for loading. After the user has positioned a particular one of the plurality of projectile holders 24 in loading area 42 the interaction between ratchet surface 26 and pawl surface 36 holds carousel 20 in place. This relieves the user of the burden of resisting the bias of the rotational biasing member 84 while simultaneously attempting to load a projectile into a projectile holder 24 and enhances the user loading experience.

It will be appreciated that while magazine 10 enhances the user loading experience, magazine 10 continues to operate as would a conventional magazine in that in conventional air guns that make use of a magazine conventionally apply some level of compression or constriction to hold their magazines in the air guns for use and to resist recoil. In either of these actions will suffice ensure that control axle tab 34 is moved in a manner that separates ratchet surface 26 from pawl surface 36.

For example, an airgun may simply have a magazine holder that is narrow enough to receive housing 40 but only with control axle tab 34 pressed into slot 66. In such airguns, the act of inserting magazine 10 into such a magazine holder will bring one of the walls of such a holder in contact with control axle tab 34. Control axle tab 34 may be curved, faceted or otherwise shaped so when force is applied against control axle tab 34 from directions such as those that control axle tab 34 will encounter in a sliding contact with a magazine holder control axle tab 34 will move into housing 40.

As is also shown in FIG. 6, in this embodiment, carousel 20 has an optional rotational bias element space provided axially between projectile holders 24 and pawl surface 36. Bias element space 23 provides an area between carousel 20 and housing 40 in which rotational biasing element 90 can be positioned. In the embodiment illustrated rotational bias member is a coil spring and a longitudinally extending cylindrical rotational bias element space 23 is provided between projectile holders 24 and ratchet surface 26.

Additional detail regarding projectile holders 24 is shown in FIG. 7. As is shown in FIG. 7, projectile holders 24 extend generally parallel to but separated from longitudinal axis 12 and are arranged radially about longitudinal axis 12 with ratchet surface 26 and, optionally, a rotational biasing element space 23 is provided between longitudinal axis 12 and the plurality of projectile holders 24.

Figure 8:
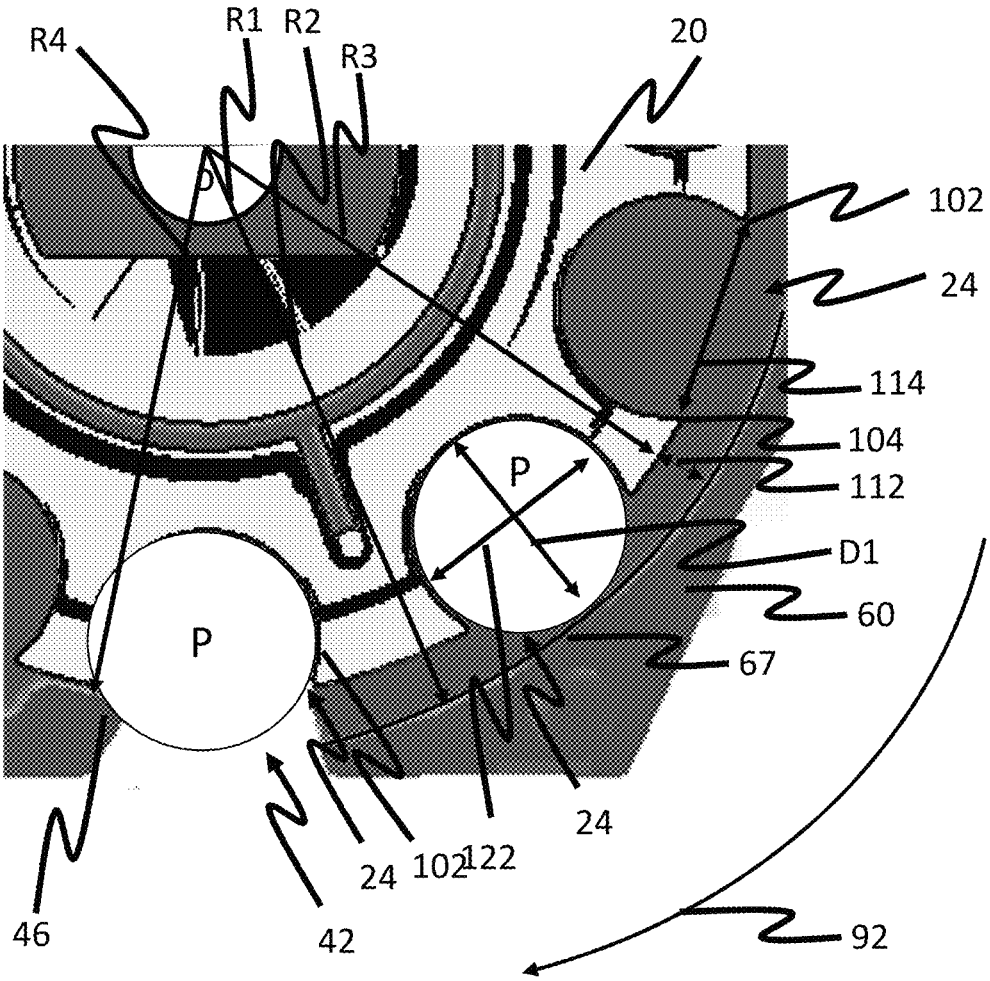
FIG. 8 is an illustration of a frontal view of a cut away portion of magazine including carousel, second housing part and projectiles.

FIG. 8 is an illustration of a frontal view of a cut away portion of magazine 10 including carousel 20, second housing part 60 and projectiles P. As is shown in FIG. 8, in this embodiment a projectile holder 24 has holding walls 100 and 102 that extend generally parallel to the longitudinal axis 12 and are shaped to receive and to position a projectile P generally parallel to the longitudinal axis 12.

In this embodiment, carousel holding space 64 of second housing part 60 is at least partially enclosed by a longitudinally extending wall 67 of cylindrical form however other arrangements are possible so long as there is no interference with the rotation of carousel 20. Wall 67 is shown as being at a first radius R1 generally from longitudinal axis 12 while carousel 20 is shown having projectile holders 24 that begin at a second radius R2 from longitudinal axis 12 and end at a third longitudinal distance R3 from longitudinal axis 12. A clearance distance 112 is provided between holding walls 100 and 102 and longitudinally extending wall 67.

In application, projectile holders 24 will be sized and shaped to receive a projectile P that is of a particular caliber having a diameter D and the second radius R2 is selected so that the second radius R2 plus the diameter D is less than the radius R1 to allow rotation of a carousel 20 loaded with projectiles P. To the extent that any variances are expected in the diameter of a projectile of a particular caliber such variances can be factored into the determination of R1 and R2 so as to ensure that clearance remains between a projectile of a maximum expected diameter and wall 67.

It will also be observed that holding walls 100 and 102 do not fully surround projectiles P held in a projectile holder 24. Instead holding walls surround a portion of a perimeter of a projectiles P held in projectile holder 24. This leaves a projectile holder gap 114 between wall 67 and holding walls 100 and 102 within from a portion of projectile held in projectile holder 24 extends.

This approach offers a number of benefits. As an initial matter, the overall width, weight and complexity of magazine 10 is reduced as material and structure necessary to fully surround the projectile is not provided. Further, no accommodation for the extra material required to surround the projectile is made. For example, in the event that projectiles P loaded into carousel 20 were to be fully surrounded by a projectile holder further clearance between a surrounding wall would be necessary and the rotating mass of the carousel and inertial loading caused by a heavier carousel with a greater radius would be increased which may impact other aspects of the design of magazine 10.

However, this embodiment does not use carousel 20 to rotate projectiles P into loading area 42 without providing some measure of control over the radial movement of projectiles P. This helps, for example, to limit the extent of movement of projectiles within a projectile holder as may be caused by centrifugal forces for example when carousel is rotated rapidly when used in an airgun or caused by gravity or other accelerations.

Accordingly, projectile holders 24 are shaped to wrap around at least a radial mid-point of a diameter of a projectile P loaded into a projectile holder 24 to resist movement of projectile P away from longitudinal axis 12 about which carousel 20 rotates.

Accordingly, carousel 20 can have holding walls 100 and 102 can extend from the longitudinal axis 12 for example by a third radius R3 that is less than the second radius from the longitudinal axis 12 plus the diameter of a caliber of projectile P that projectile holder 24 is designed to hold as long as the radius to the projectile holder R2 plus the dimeter D of the caliber of the projectile P to be held in projectile holder 24 is less than the radius R1 of the wall 67.

As is also shown in FIG. 8 is a projectile holder 24 located in a loading area 42 the features of which will now be described. As noted previously loading area 42 provides a longitudinal pathway through magazine 10 through which a bolt of an airgun (not shown) can advance to drive a projectile P from projectile holder 24 into the airgun.

Such a loading process benefits from accurate positioning of the projectile at a predetermined location relative to loading area 42 and magazine housing 40 more generally.

As discussed previously, when magazine 10 is loaded in an airgun magazine holder, carousel 20 is urged by rotational biasing element 90 to rotate in a first direction 92 about longitudinal axis 12. This provides a force urging a projectile P into a loading area 42 and ultimately against a projectile stop surface 46. Where, as illustrated here, loading end 44 of magazine 10 is positioned at a lower end of the arc of rotation of projectile holders, the use of holding walls 100 and 102 that are shaped to restrict the movement of projectile P away from longitudinal axis 12 is useful to prevent projectile P from being drawn by gravity out of projectile holder 24 as projectile holder 24 advanced through loading area 42.

Projectile stop surface 46 is positioned at a fourth radius R4 from longitudinal axis 12 that is between the holding wall radius R3 and the sidewall radius R4 such that the projectile stop surface 40 fills enough of clearance distance 112 between projectile holding walls 100 and 102 and wall 67 to block travel of projectile P at a preferred location for a bolt B of an airgun to drive projectile P into a breach or other component of the airgun. The biasing force acting on carousel 20 then urges holding wall 102 against projectile P to help maintain projectile P in this position until projectile P is moved from projectile holder 24.

Figure 9:
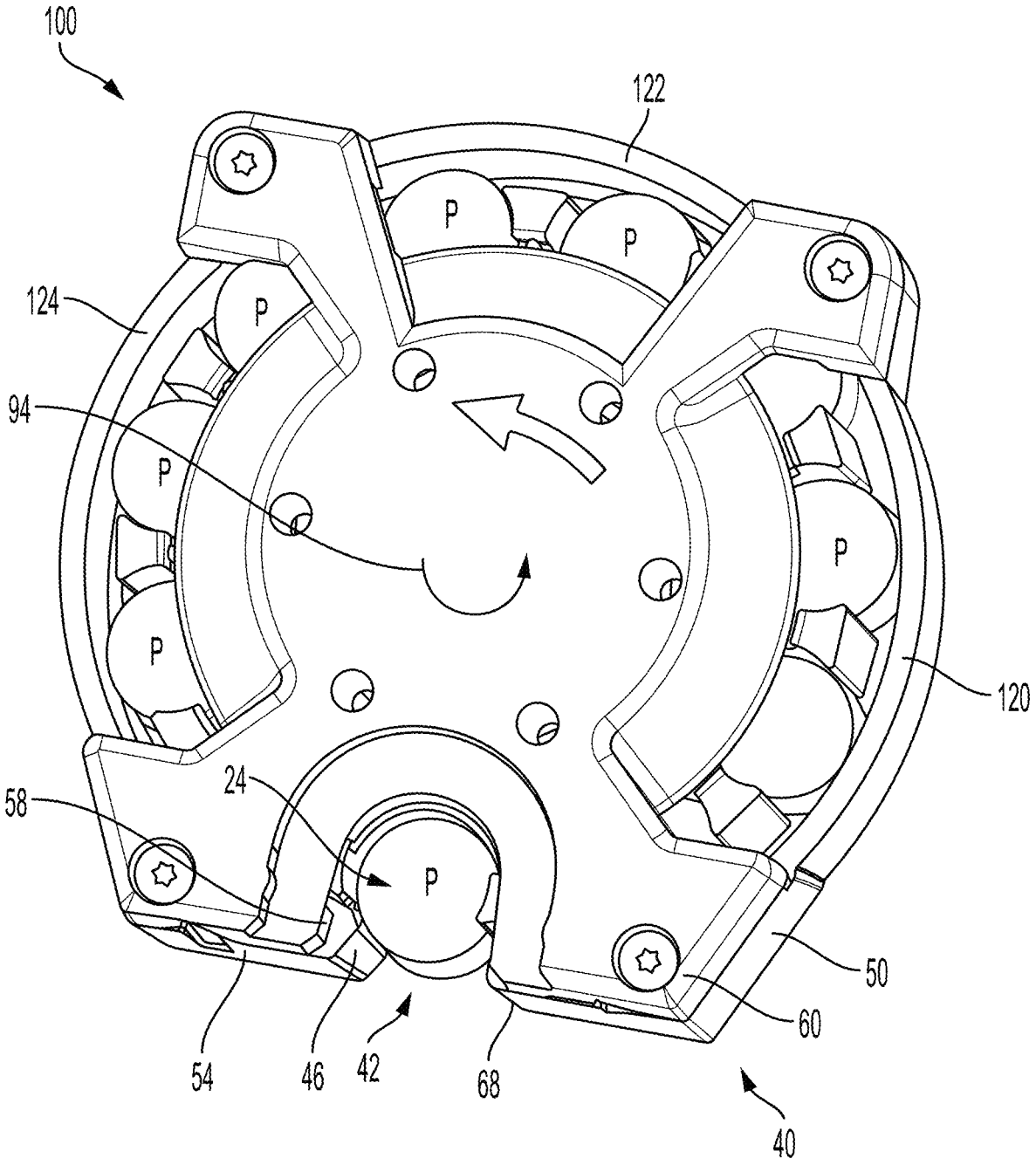
FIG. 9 is a front, bottom left side view magazine with one embodiment of a first housing part mounted to second housing part to form a complete housing.

FIG. 9 shows a front, bottom left side view of magazine 10 with one embodiment of a first housing part 50 mounted to second housing part 60 to form a complete housing 40. As is shown in FIG. 9, in this embodiment, projectile stop surface 46 extends longitudinally for a distance between first opening 58 and second opening 68.

During loading, a user rotates carousel 20 in second direction 94. To do this, a user must have a path or a mechanism by which the user can apply force to move carousel 20.

In the embodiment illustrated, the weight, size and complexity required to provide such access is reduced by a first housing part 50 that has a plurality openings 120, 122 and 124 in areas that allow a user to use for example a thumb of a hand holding magazine 10 to contact carousel 20 and urge motion of carousel 20. Here the arrangement of openings 150, 152, and 154 allows ambidextrous control over positioning of carousel 20 during loading by for example, using the thumb of a holding hand as is described and using other methods that may find the ready access to carousel useful in such efforts.

In embodiments housing 40 can be provided with access to carousel 20 by providing a pathway into which a user can insert a portion of a hand or by providing a pathway that positions one or more portions of carousel 20 outside of housing 40. Portions of carousel 20 can be shaped to provide preferred interactions with a user during rotation.

It will also be observed in FIGS. 8 and 9, that first opening 58 and second opening 68 extend from a loading end of 54 of magazine 10 to loading area.

Figure 10:
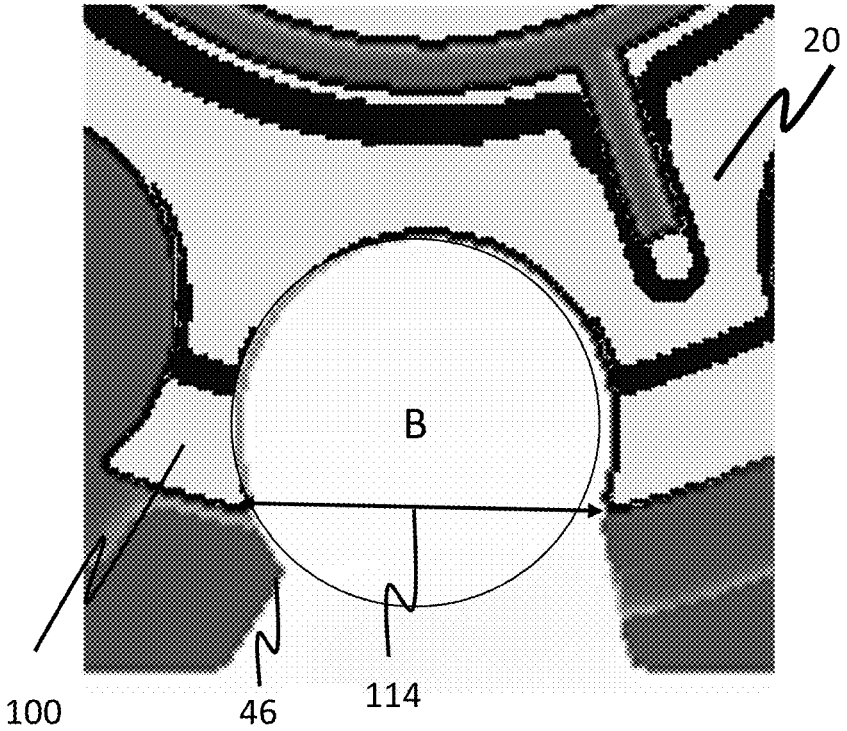
FIG. 10 is an illustration of a frontal view of a cut away portion of magazine including carousel, second housing part with a projectile P.

FIG. 10 is an illustration of a frontal view of a cut away portion of magazine 10 including carousel 20, second housing part 60 with a cross section of a bolt B of an airgun (not shown). In this position, rotation of carousel 20 is blocked by bolt B.

As is located in a projectile holder 24 that is positioned in loading area 42. In the event that a user wishes to change or remove magazine 10 from airgun, magazine 10 can be separated from bolt B without damage or disruption to the operation of either magazine 10 or bolt B.

This is accomplished in part by the use of projectile holders 24 with holding walls 100 and 102 that are separated by projectile holder gap 114. This allows bolt B to travel through projectile holder gap 114. However, the need to allow bolt B to pass between holding walls 100 and 102 must be balanced against the need to hold projectiles P in projectile holders 24.

Accordingly, projectile holder gap 114 is not sized so large as to allow movement of a projectile P. In embodiments, airgun (not shown) may have a bolt B that is smaller in diameter than a projectile P such that projectile holder gap 114 can retain a projectile P while allowing a bolt B having a diameter that is sufficiently smaller than a diameter of projectile P to pass through projectile holder gap 114.

Figure 11:
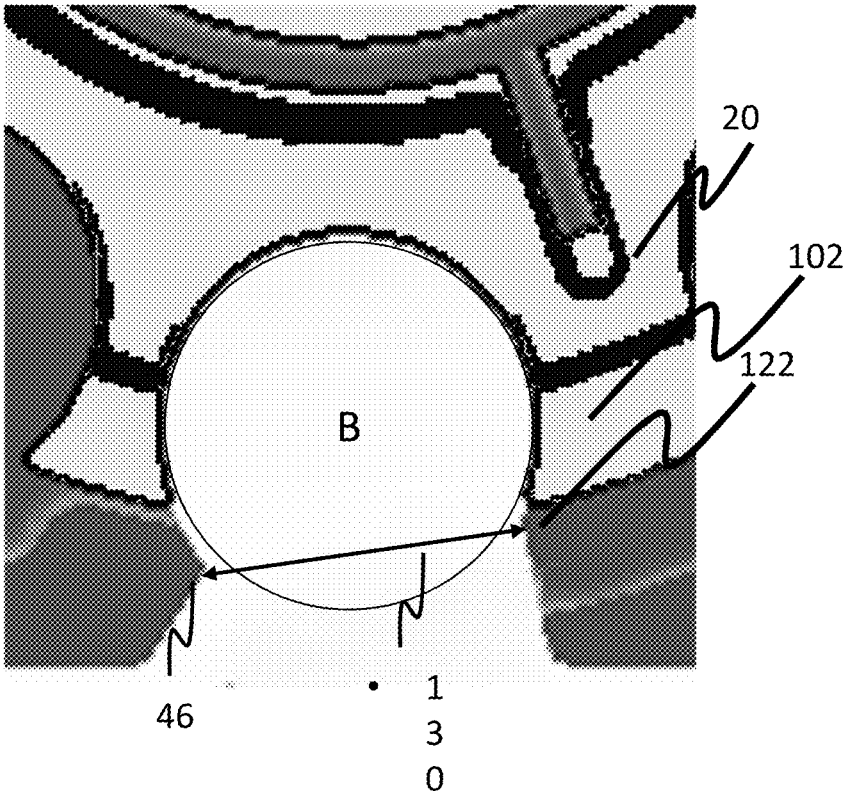
FIG. 11 is an illustration of a frontal view of a cut away portion of magazine including carousel, second housing part with a cross section of a bolt of an airgun (not shown).

In other circumstances, as illustrated in FIG. 11, an airgun bolt B will have a diameter that is too similar to that of a diameter of a projectile P to provide for reliable discrimination on the basis of a size of projectile holder gap 114 alone. In the embodiment illustrated in FIG. 11, projectile holders 24 has holding walls 100 and 102 that are separated by a projectile holder gap 114 that is insufficient to permit either projectiles P or bolt B to pass. However, in this embodiment holding walls 100 and 102 are resiliently compressible or resiliently deflectable when exposed to forces of the type or level associated with the separation of magazine 10 from airgun bolt B while remaining static when confronted with forces of created by a projectile P in normal carousel feeding operation.

The ability to separate magazine 10 from an airgun bolt B as described, is also provided in part by the use of a housing 40 having first opening 58 and second opening 68 that extend from loading area 42 through housing 40 at loading end 44. However as can be seen in FIG. 11, in embodiments projectile stop surface 46 may combine with other components of housing 40 such as edge 48 to provide a housing gap 130 that is smaller than a diameter of a bolt B of an airgun.

Here too, housing 40 may be formed with materials that are resiliently compressible or resiliently deflectable when exposed to forces of the type or level associated with the separation of magazine 10 from airgun bolt B as may be necessary to allow bolt B to separate from magazine 10.

In embodiments, the use of such resilient materials can produce a snap type effect of a sound or vibrational sensation that indicative of the separation of magazine 10 from bolt B.

In other embodiments, first housing part 50 and second housing part 60 may be joined together in other ways such as by ultrasonically welding or thermally welding first housing part 50 to second housing part 60. Alternatively other methods for joining separable housing parts may be used including hot staking, using adhesive or by way of snap fit or other known mechanical fastening design features. In embodiments a first housing part may be joined to a second housing part by way of magnetic attraction between magnets or between a magnet and ferromagnetic or other magnetically attractive material in first housing part 50 and the second housing part 60.

In embodiments, magazine 10 may be formed in whole or in part using additive manufacturing. In embodiments magazine housing 40 and any or all other components of magazine 10 may be formed using additive manufacturing. Additionally, in embodiments magazine housing 50 may be formed using additive manufacturing with one or more components formed in other ways and inserted during the additive manufacturing process.

In other embodiments, a magnet can be provided proximate first end 33 of control axle 30 that can overcome the bias force of control axle biasing element 80 when in the presence ferromagnetic materials or paramagnetic materials such as metals that are commonly used in airgun magazine holders.

In the embodiment of FIG. 2 carousel 20 is generally fixed longitudinally relative to control axle 30, however other embodiments are possible where this arrangement is reversed or where both carousel 20 and control axle 30 are moved longitudinally to bring ratchet surface 26 and pawl surface 36 into or out of contact.

The invention has been described in detail with particular reference to certain preferred embodiments thereof, but it will be understood that variations and modifications can be effected within the scope of the invention.

What is claimed is:

1. A projectile magazine for use with an airgun having a bolt, the projectile magazine comprising:

a housing;

a carousel positioned within the housing, and having a first side and a second side opposite the first side, the carousel including:

a hub protruding from the second side and extending in a first direction, a first ratchet interface arranged around a perimeter of the hub, and a plurality of projectile holders disposed radially about the hub adjacent a perimeter of the carousel, wherein a projectile holder of the plurality of projectile holders defines a projectile holder gap at the perimeter of the carousel;

an axle including a second ratchet interface, wherein the second ratchet interface is configured to engage with the first ratchet interface;

a rotational biasing element configured to impose a first biasing force on the carousel, the first biasing force causing rotation of the carousel about an axis of the axle in a rotational direction; and an axle biasing element configured to impose a second biasing force on the carousel in a second direction that is opposite the first direction, the second biasing force causing the first ratchet interface to engage with the second ratchet interface.

2. The projectile magazine of claim 1, wherein:

the projectile holder gap has a first width, the bolt has a second width that is greater than the first width, the projectile holder includes a deformable portion adjacent the projectile holder gap configured to allow the projectile holder gap to expand to a third width that is greater than the second width when the deformable portion is displaced, and wherein engagement of an outside surface of the bolt with an inside surface of the projectile holder displaces the deformable portion, thereby causing the projectile holder gap to expand to the third width.

3. The projectile magazine of claim 1, wherein a projectile holder of the plurality of projectile holders includes:

a first holding wall, and a second holding wall, and wherein:

the first holding wall and the second holding wall define the projectile holder gap, the first holding wall and the second holding wall comprise a deformable portion, and the first holding wall and second holding wall are coupled to define a semicircular channel configured to envelop an outside circumference of a projectile by more than 180°.

4. The projectile magazine of claim 1, wherein the first ratchet interface includes a plurality of teeth, and individual ones of the plurality of teeth include:

a first surface positioned at a first angle relative to an axis of the hub such that the first surface is not parallel to the axis of the hub, and a second surface positioned at a second angle relative to the axis of the hub such that the second surface is substantially parallel with the axis of the hub.

5. The projectile magazine of claim 4, wherein the first biasing force and the second biasing force cause the first ratchet interface to engage with the second ratchet interface.

6. The projectile magazine of claim 1, wherein the axle includes a tab configured to couple with the housing to prevent rotation of the axle relative to the housing.

7. The projectile magazine of claim 1, further including a projectile surface stop within the housing contacting an inside surface of the first side of the housing, wherein the projectile surface stop is configured to contact a projectile positioned within a projectile holder of the plurality of projectile holders, and to prevent the projectile from rotating past the projectile surface stop.

8. A system, comprising:

a projectile magazine for use with an airgun having a bolt, the projectile magazine comprising:

a housing;

a carousel positioned within the housing and having a first side and a second side opposite the first side, the carousel including:

a hub protruding from the second side and extending in a first direction, a first ratchet interface arranged around a perimeter of the hub, and a plurality of projectile holders disposed radially about the hub adjacent a perimeter of the carousel, wherein a projectile holder of the plurality of projectile holders defines a projectile holder gap at the perimeter of the carousel;

an axle, including a second ratchet interface, wherein the second ratchet interface is configured to engage with the first ratchet interface;

a rotational biasing element configured to impose a first biasing force on the carousel, the first biasing force causing rotation of the carousel about an axis of the axle in a rotational direction; and an axle biasing element configured to impose a second biasing force on the carousel in a second direction that is opposite the first direction to cause the first ratchet interface to engage with the second ratchet interface.

9. The system of claim 8, wherein:

the projectile holder gap has a first width, the bolt has a second width that is greater than the first width, the projectile holder includes a deformable portion adjacent the projectile holder gap configured to allow the projectile holder gap to expand to a third width that is greater than the second width when the deformable portion is displaced, and wherein engagement of an outside surface of the bolt with an inside surface of the projectile holder displaces the deformable portion, thereby causing the projectile holder gap to expand to the third width.

10. The system of claim 8, wherein a projectile holder of the plurality of projectile holders includes:

a first holding wall, and a second holding wall, and wherein:

the first holding wall and the second holding wall define the projectile holder gap, the first holding wall and the second holding wall comprise a deformable portion, and the first holding wall and second holding wall are coupled to define a semicircular channel configured to envelop an outside circumference of a projectile by more than 180°.

11. The system of claim 8, wherein the first ratchet interface includes a plurality of teeth, wherein:

individual ones of the plurality of teeth include:

a first surface positioned at a first angle relative to an axis of the hub such that the first surface is not parallel to the axis of the hub, and a second surface positioned at a second angle relative to the axis of the hub such that the second surface is substantially parallel with an axis of the hub.

12. The system of claim 11, wherein the first biasing force and second biasing force together cause the first ratchet interface to engage with the second ratchet interface.

13. The system of claim 8, wherein the axle includes a tab configured to couple with the housing to prevent rotation of the axle relative to the housing.

14. The system of claim 8, further including a projectile surface stop within the housing contacting an inside surface first side of the housing, wherein the projectile surface stop is configured to contact a projectile positioned within a projectile holder of the plurality of projectile holders and prevent the projectile from rotating past the projectile surface stop.

15. A component for an airgun having a bolt and a built-in magazine housing, the component comprising:

a carousel positioned within the built-in magazine housing and having a first side and a second side opposite the first side, the carousel including:

a hub protruding from the second side and extending in a first direction, a first ratchet interface arranged around a perimeter of the hub, and a plurality of projectile holders disposed radially about the hub adjacent a perimeter of the carousel, wherein a projectile holder of the plurality of projectile holders defines a projectile holder gap at the perimeter of the carousel;

an axle within the built-in magazine housing, including a second ratchet interface , wherein the second ratchet interface is configured to engage with the first ratchet interface;

a rotational biasing element configured to impose a first biasing force on the carousel, the first biasing force causing rotation of the carousel about an axis of the axle in a rotational direction; and an axle biasing element configured to impose a second biasing force on the carousel in a second direction that is opposite the first direction, the second biasing force causing the first ratchet interface to engage with the second ratchet interface.

16. The component of claim 15, wherein:

the projectile holder gap has a first width, the bolt has a second width that is greater than the first width, the projectile holder includes a deformable portion adjacent the projectile holder gap configured to allow the projectile holder gap to expand to a third width that is greater than the second width when the deformable portion is displaced, and wherein planar engagement of an outside surface of the bolt with an inside surface of the projectile holder displaces the deformable portion to expand the projectile holder gap to the third width.

17. The component of claim 15, wherein a projectile holder of the plurality of projectile holders include:

a first holding wall, and a second holding wall, and wherein:

the first holding wall and the second holding wall define the projectile holder gap, the first holding wall and the second holding wall comprise a deformable portion, and the first holding wall and second holding wall are coupled to define a semicircular channel configured to envelop an outside circumference of a projectile by more than 180°.

18. The component of claim 15, wherein the first ratchet interface includes a plurality of teeth, wherein:

individual ones of the plurality of teeth include:

a first surface positioned at a first angle relative to an axis of the hub such that the first surface is not parallel to the axis of the hub, and a second surface positioned at a second angle relative to the axis of the hub such that the second surface is substantially parallel with the axis of the hub.

19. The component of claim 18, wherein the axle includes a tab configured to couple with the built-in magazine housing to prevent rotation of the axle relative to the built-in magazine housing.

20. The component of claim 15, further including a projectile surface stop within the built-in magazine housing contacting an inside surface first side of the built-in magazine housing, wherein the projectile surface stop is configured to contact a projectile positioned within a projectile holder of the plurality of projectile holders and prevent the projectile from rotating past the projectile surface stop.

* * * * *